US005858115A

United States Patent [19]

Runyon

[11] Patent Number: 5,858,115

[45] Date of Patent: Jan. 12, 1999

[54] CLEANING DEVICE CLEANING SYSTEM AND METHOD RELATED THERETO

[76] Inventor: Velma Finch Runyon, Rt. 1, Box 381, Delbarton, W. Va. 25670

[21] Appl. No.: 876,065

[22] Filed: Jun. 13, 1997

[51] Int. Cl.[6] ..... A47L 13/12

[52] U.S. Cl. ..... 134/25.2; 134/6; 15/104.94; 15/208; 15/209.1; 15/210.1; 15/211; 15/220.1; 15/244.3

[58] Field of Search ..... 134/25.2, 6; 15/104.94, 15/208, 209.1, 210.1, 211, 220.1, 244.3

[56] References Cited

U.S. PATENT DOCUMENTS

| | | | |
|---|---|---|---|
| 2,297,639 | 9/1942 | Thauwald | 15/209.1 |
| 3,608,708 | 9/1971 | Storandt | 15/104.94 |
| 3,716,885 | 2/1973 | Thompson | 15/210.1 |
| 4,015,306 | 4/1977 | Fenster | 15/209 R |
| 4,075,033 | 2/1978 | Knox et al. | 15/210.1 |
| 4,821,360 | 4/1989 | Giallourakis | 15/244.3 |
| 4,959,881 | 10/1990 | Murray | 15/104.94 |
| 5,083,337 | 1/1992 | Jones | 15/104.94 |
| 5,177,831 | 1/1993 | Wirth | 15/244.3 |
| 5,341,538 | 8/1994 | Banome | 15/209.1 |
| 5,408,718 | 4/1995 | Sadovsky | 15/244.3 |
| 5,548,862 | 8/1996 | Curtis | 15/118 |
| 5,598,596 | 2/1997 | Jones et al. | 15/1.52 |

*Primary Examiner*—Jill Warden
*Assistant Examiner*—S. Carrillo
*Attorney, Agent, or Firm*—Robert N. Blackmon

[57] ABSTRACT

A cleaning device, cleaning system and method relating thereto are provide. The cleaning device comprises (a) a handle unit having a (i) a handle section and (ii) a support section, (b) a body comprising (i) a deformable foundation supported by the support section (ii) a lofted fibrous material overlaying the foundation (iii) water proof plastic layer covering the fibrous material to prevent water contact of the fibrous material and foundation; (c) a cleaning skirt optionally having (i) a cloth cleaning section for enveloping the body and (ii) an elastic section for selectively retaining the skirt on the body. The cleaning system comprises (a) the cleaning device and (b) a plurality of cleaning skirts. The cleaning method comprises (a) providing a cleaning device as set out above, (b) cleaning a first household item with the device, (c) replacing the used skirt with a second skirt, and (d) cleaning a second household item with the device. The cleaning device, system and method are useful for cleaning of a plurality of household items.

5 Claims, 2 Drawing Sheets

CLEANING DEVICE CLEANING SYSTEM AND METHOD RELATED THERETO

BACKGROUND OF THE INVENTION

1. Field of the Invention

The present invention relates to cleaning tools and methods related thereto, and more particularly relates to handled cleaning tools and methods related thereto.

2. Description of the Related Art

Conventional cleaning techniques for cleaning of household structures such as windows, tables and dishes have typically involved the need to utilize separate cleaning tools and cleaning solutions. For example, cleaning of windows often utilizes a cloth rag, a bucket of water-based cleaning composition and a squeegee-type water remover; cleaning of tables has typically involved the use of a duster, cloth rag, and a furniture polish composition; and cleaning of dishes has often used a cleaning brush, a cleaning rag, soap and water.

Consequently, cleaning of multiple household items has typically required plurality of tools to clean the multiple household items.

SUMMARY OF THE INVENTION

The present invention involves a cleaning device, cleaning systems and methods relating thereto. The cleaning device comprises (a) a handle unit having a (i) a handle section and (ii) a support section, (b) a body comprising (i) a deformable foundation supported by the support section (ii) a lofted fibrous material overlaying the foundation (iii) water proof plastic layer covering the fibrous material to prevent water contact of the fibrous material and foundation; (c) a cleaning skirt optionally having (i) a cloth cleaning section for enveloping the body and (ii) an elastic section for selectively retaining the skirt on the body. The cleaning system comprises (a) the cleaning device and (b) a plurality of cleaning skirts. The cleaning method comprises (a) providing a cleaning device as set out above, (b) cleaning a first household item with the device, (c) replacing the used skirt with a second skirt, and (d) cleaning a second household item with the device. The cleaning device, system and method, permits fast (quick) and easy cleaning of a plurality of household items allowing the user to finish a cleaning task in relatively short time.

DETAILED DESCRIPTION OF THE INVENTION

Figure 1:
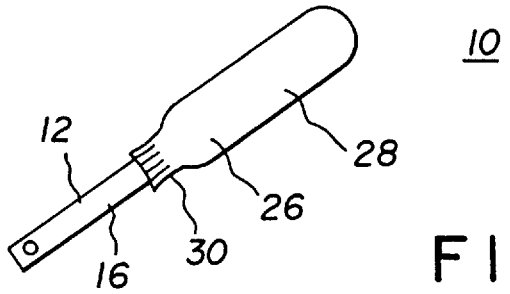
FIG. 1 is a perspective view of a cleaning device according to the present invention.
Figure 2:
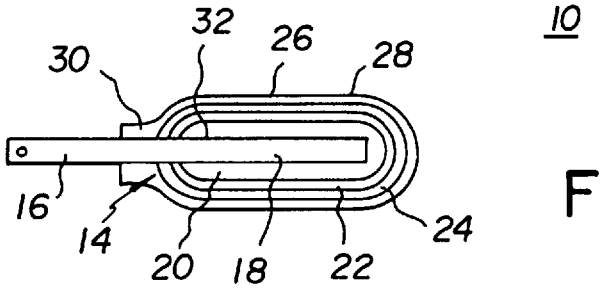
FIG. 2 is a cross-sectional view of the cleaning device of the present invention.
Figure 3:
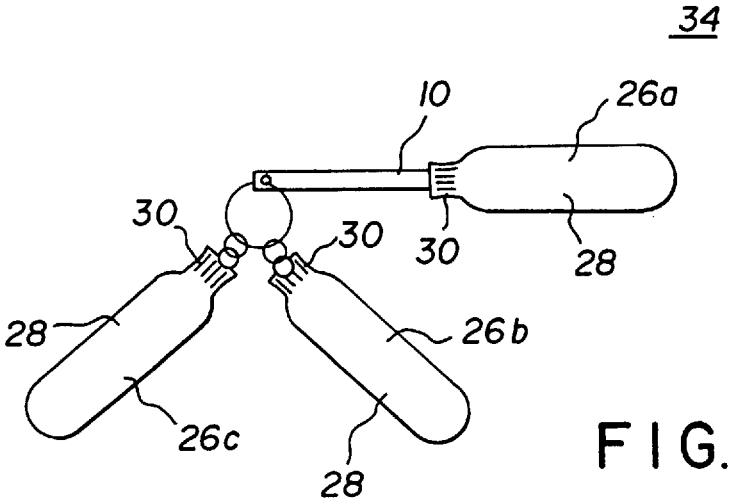
FIG. 3 is a cleaning system according to the present invention.

As best shown in FIGS. 1 and 2, a cleaning device (10) comprises (a) a handle (12), a body (14), and a cleaning skirt (26). The handle (12) has (i) a handle section (16) and (ii) a support section (18). The body (14) comprises (a) a deformable foundation (20) supported on the support section (18), (b) a lofted fibrous material (22) overlaying the foundation (20), (c) a water proof plastic layer (24) covering the fibrous material (22) to prevent water from contacting the foundation (20) or the lofted fibrous material (22). The cleaning skirt (26) envelopes the body (14) to provide a removable cleaning surface for the device (10). As best shown in FIG. 3, the cleaning system (34) comprises (a) a cleaning device (10) and (b) a plurality of cleaning skirts (26*a, b, c*). The plurality of removable skirts (26 *a,b,c*) allows for quick and easy cleaning of a plurality of household items (such as dishes, windows and furniture) in a sequential fashion.

The handle (12) may be made of any suitable rigid material such as wood (oak, hickory) or plastic. The handle (12) is elongated and may suitably have a cylindrically shaped handle section (16). The support section (18) may also be cylindrically shaped. The width (diameter) of the handle (12) is preferably between 0.4 and 1.0 inches, for example 0.5 to 0.7 inches. Preferably the handle (12) has a length of between 10 inches and 24 inches, for example between 12 inches and 18 inches.

The foundation (20) is preferably made of a firm sponge matter such as natural loofah sponge or synthetic sponge matter. The foundation is preferably of a cylindrical shape having a central receiving orifice (32) for receiving the support section (18) of the handle (12). The foundation (20) preferably has a width (diameter) of between 1.5 and 4.0 inches or preferably between 2.0 and 3.0 inches. The foundation (20) may be attached to the handle (12) by a friction fit or by mechanical or adhesive means.

The lofted fibrous material (22) overlays the foundation (20) and provides a potentially more continuous and tear resistant layer than the underlying foundation (natural sponge) layer. The lofted fibrous material (22) is preferably quilt batting made of cotton, synthetic (polyester) fiber or blends thereof. The quilt batting (lofted fibrous material) layer preferably has a lofted (uncompressed) thickness of 0.1 to 0.5 inches, preferably from 0.2 to 0.3 inches. The quilt batting (22) envelopes the foundation (20). The term envelope is meant to mean that the underlying layer is essentially covered except for the handle entry zone.

The water proof plastic layer (24) may be made of conventional plastic flexible film such as polyethylene, polypropylene or polyester films. The film layer (24) envelopes the body (14) (quilt batting) to prevent water from contacting the batting layer (22) and the foundation (20). The film (24) is preferably 0.001 to 0.1 inches thick, more preferably from 0.01 to 0.05 inches thick. The skirt (26) is preferably a cloth (woven fiber, fabric) material having a cleaning portion (28) and an elastic portion (30). The cleaning portion (28) is preferably free of elastic material. The cleaning portion (28) is preferably at least as long as the body (14). The elastic portion (30) extends past the body (14). The elastic portion (30) has a relaxed diameter of less than that of the body (14) to provide a releasable capturing force sufficient to cause a skirt to capture the body (14) when the skirt is pulled over the body (14). The elastic nature of the elastic portion (30) permits expansion of the elastic portion (30) to a diameter of at least the diameter of the body (14) to permit the skirt to be pulled over the body (14).

The preferred skirt (sock) (26) is a polyester cotton blend having properties suitable for multiple use on furniture, windows and dishes. If needed, the body (14) is washable and can be used successively on dishes, windows and furniture by removing and replacing the skirt (26*a*) after use with a successive skirt (26*b* or 26*c*). Preferably the skirt (26) is cotton or cotton polyester blend.

The device (10), system (34) and method allows for quick and easy cleaning of multiple house hold items sequentially.

Various sponge materials are set out in Wirth U.S. Pat. No. 5,177,831 issued Jan. 12, 1993; Benarrouch U.S. Pat. No. 4,609,301 issued Sep. 2, 1986; and Ballares et al U.S. Pat. No. 5,277,389 issued Jan. 11, 1994, all of which are incorporated herein by reference. Quilt batting materials are disclosed in Hudson U.S. Pat. No. 5,488,746 issued Feb. 6, 1996; Fankosky et al U.S. Pat. No. 5,527,600 issued Jun. 18, 1996; and Hernandez et al U.S. Pat. No. 5,458,971 issued Oct. 17, 1995, all of which are incorporated herein by reference. Water proof plastic films (bags) are disclosed in Aumann U.S. Pat. No. 5,698,916 issued Mar. 11, 1997; Trimble U.S. Pat. No. 5,600,938 issued Feb. 11, 1997; Mitchell U.S. Pat. No. 3,974,960 issued Aug. 17, 1996; and Ielmini et al U.S. Pat. No. 5,056,934 issued Oct. 15, 1991, all of which are disclosed herein by reference. Cotton and cotton-polyester blend fabrics are disclosed in Russ et al U.S. Pat. No. 5,498,267 issued Mar. 12, 1996 and Serel et al U.S. Pat. No. 5,342,854 both of which are incorporated herein by reference. Elastics are known for socks and have for example been disclosed in Wilkenson et al U.S. Pat. No. 4,561,267 which is incorporated herein by reference.

Figure 4:
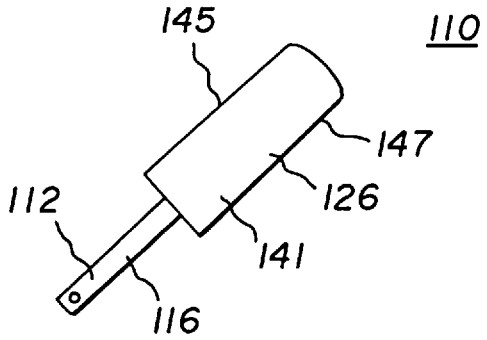
FIG. 4 is a perspective view of an alternative embodiment of the cleaning device of the present invention.
Figure 5:
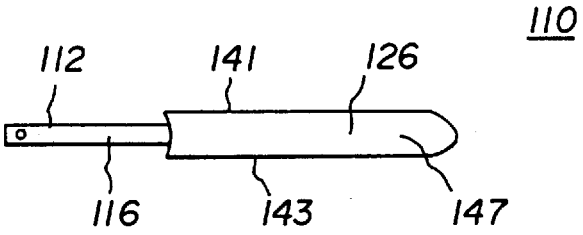
FIG. 5 is a side elevational view of the cleaning device of FIG. 4.
Figure 6:
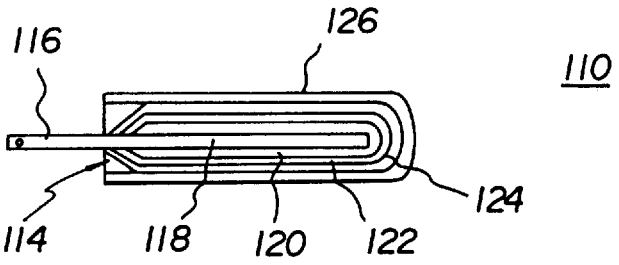
FIG. 6 is a horizontal cross-sectional view of the cleaning device of FIG. 5.

As shown in FIGS. 4, 5 and 6, an alternative embodiment of the cleaning device (110) of the present invention is provided. The cleaning device (110) lacks the elastic of the cleaning device (10) of FIGS. 1, 2 and 3, and instead relies on the elastic compressed status of the body (114) to provide retaining force to the skirt (126) which is sized slightly smaller in internal volume than the uncompressed state of the body (114).

The cleaning device (110) comprises (a) a handle (112), a body (114), and a cleaning skirt (126). The handle (12) has (i) a handle section (116) and (ii) a support section (118). The body (114) comprises (a) a deformable foundation (120) supported on the support section (118), (b) a lofted fibrous material (122) overlaying the foundation (120), (c) a water proof plastic layer (124) covering the fibrous material (122) to prevent water from contacting the foundation (120) or the lofted fibrous material (122). The cleaning skirt (126) envelopes the body (114) to provide a removable cleaning surface for the device (110). As shown in FIGS. 4 and 5, the cleaning device (110) preferably has a relatively wide top (141) and bottom (143), and a relatively narrow sides (145,147) for facilitating cleaning of large flat surfaces.

EXAMPLE

A device was made having a handle, a natural sponge foundation material overlaying the support section of the handle, quilt batting was used to envelope the foundation, a waterproof polymeric film was used to envelope the quilt batting and a skirt having an elastic portion and a cleaning portion was pulled over the body. The device was then used to dust furniture and a quick and easy fashion without the need for furniture polish, the device was used to clean windows without the need of window cleaning fluid, and then the skirt was removed and replaced with a clean skirt and dishes were washed.

What is claimed is:

1. A cleaning system comprising:

(a) a cleaning device comprising:

(i) a handle having a handle section and support section, (ii) a sponge foundation overlaying the support section, (iii) a lofted fibrous material covering the foundation, (iv) a waterproof plastic film enveloping the fibrous material, (v) a first skirt having an elastic portion and a cleaning portion, said skirt being pulled over said plastic film, (b) a second skirt for permitting quick and easy replacement of said first skirt.

2. The system of claim one wherein said first and second skirts are made of a cotton-polyester fiber blend cloth.

3. A cleaning device comprising:

(a) a cleaning device comprising:

(i) a handle having a handle section and support section, (ii) a body affixed to said handle, said body comprising (A) a sponge foundation overlaying the support section, (B) a lofted fibrous material covering the foundation, and (C) a waterproof plastic film enveloping the fibrous material, (iii) a skirt, said body being received within said skirt, said skirt having an internal size less than an uncompressed volume of said body, said skirt being retained on said body by said body being in a compressed state when said skirt envelopes said body.

4. A method for cleaning a plurality of household items sequentially said method comprising:

(a) providing a cleaning device comprising:

(i) a handle having a handle section and support section, (ii) a sponge foundation overlaying the support section, (iii) a lofted fibrous material covering the foundation, (iv) a waterproof plastic film enveloping the fibrous material, (v) a first skirt having an elastic portion and a cleaning portion, said skirt being pulled over said plastic film, (b) cleaning a first household item with said device resulting in said skirt accumulating particulates, (c) removing said skirt from said film, (d) placing a second skirt over said film, (e) cleaning a second household item.

5. The method of claim four wherein said first household item is a dish and said second household item is wooden furniture, said cleaning of said first household item comprising using a water-based cleaning composition.

* * * * *